US009777455B2

(12) United States Patent
Sutton et al.

(10) Patent No.: US 9,777,455 B2
(45) Date of Patent: Oct. 3, 2017

(54) WATER-PERMEABLE WOVEN GEOTEXTILE

(71) Applicant: LUMITE, INC., Alto, GA (US)

(72) Inventors: R. Alan Sutton, Gainesville, GA (US); Rebecca Kurek, Flowery Branch, GA (US); Greg Hendrix, Cleveland, GA (US)

(73) Assignee: LUMITE, INC., Alto, GA (US)

( * ) Notice: Subject to any disclaimer, the term of this patent is extended or adjusted under 35 U.S.C. 154(b) by 37 days.

(21) Appl. No.: 15/146,295

(22) Filed: May 4, 2016

(65) Prior Publication Data

US 2016/0348333 A1 Dec. 1, 2016

Related U.S. Application Data

(60) Provisional application No. 62/169,043, filed on Jun. 1, 2015.

(30) Foreign Application Priority Data

Nov. 16, 2015 (CA) ..... 2912108

(51) Int. Cl.

| | |
|---|---|
| ***E01C 11/00*** | (2006.01) |
| ***E02D 17/20*** | (2006.01) |
| ***E01C 3/00*** | (2006.01) |
| ***D03D 1/00*** | (2006.01) |
| ***D03D 15/00*** | (2006.01) |

(Continued)

(52) U.S. Cl.

CPC ..... *E02D 17/202* (2013.01); *D03D 1/00* (2013.01); *D03D 15/0088* (2013.01); *E01C 3/003* (2013.01); *E02D 3/00* (2013.01); *D10B 2505/204* (2013.01); *E01C 7/325* (2013.01); *E02D 2300/0078* (2013.01)

(58) Field of Classification Search

CPC . E01C 3/003; E01C 7/325; E02D 3/00; E02D 17/202; E02D 2300/0078; D03D 1/00; D03D 15/0088; D10B 2505/204

USPC ..... 404/17, 27, 31, 71, 75, 76

See application file for complete search history.

(56) References Cited

U.S. PATENT DOCUMENTS

| | | | |
|---|---|---|---|
| 2,757,434 | A | 8/1956 | McCord et al. |
| 3,047,444 | A | 7/1962 | Harwood |
| 3,279,221 | A | 10/1966 | Gliksmann |

(Continued)

FOREIGN PATENT DOCUMENTS

| | | | |
|---|---|---|---|
| WO | 2007067833 | A2 | 6/2007 |

*Primary Examiner* — Raymond W Addie

(74) *Attorney, Agent, or Firm* — Gardner Groff Greenwald & Villanueva, PC

(57) ABSTRACT

A water-permeable woven geotextile fabric for providing soil reinforcement and/or stabilization, for example as an underlayment in road construction, utilizes a series of round warp fibers, in combination with a series of flat warp fibers, across the width of the fabric to increase water flow while still providing desired filtration. In particular, the round warp fibers form angles that allow greater amounts of water to pass through the fabric. In addition, using both round and flat warp fibers results in increased roughness of the fabric surface, which makes the fabric more resistant to being pulled out of the soil when pulled on. Furthermore, one or more of the round and/or flat warp fibers can include a color selected for high visibility to the human eye in daylight conditions.

20 Claims, 9 Drawing Sheets

(51) Int. Cl.
*E02D 3/00* (2006.01)
*E01C 7/32* (2006.01)

(56) References Cited

U.S. PATENT DOCUMENTS

| | | | |
|---|---|---|---|
| 3,696,623 | A | 10/1972 | Heine et al. |
| 4,002,034 | A | 1/1977 | Muhring et al. |
| 4,183,993 | A | 1/1980 | Benstead et al. |
| 4,421,439 | A | 12/1983 | ter Burg et al. |
| 4,472,086 | A | 9/1984 | Leach |
| 4,619,120 | A | 10/1986 | Markowitz |
| 4,790,691 | A | 12/1988 | Freed |
| 4,837,387 | A | 6/1989 | van de Pol |
| 4,957,390 | A | 9/1990 | Shoesmith |
| 4,992,003 | A | 2/1991 | Perach |
| 5,326,192 | A | 7/1994 | Freed |
| 5,567,087 | A | 10/1996 | Theisen |
| 5,612,114 | A | 3/1997 | Zalewski et al. |
| 5,616,399 | A | 4/1997 | Theisen |
| 5,795,835 | A | 8/1998 | Bruner et al. |
| 5,856,243 | A | 1/1999 | Geirhos et al. |
| 6,171,022 | B1 | 1/2001 | Decker |
| 6,305,875 | B1 | 10/2001 | Matsumoto |
| 6,368,024 | B2 | 4/2002 | Kittson |
| 6,429,153 | B1 | 8/2002 | Welkers et al. |
| 6,477,865 | B1 | 11/2002 | Matsumoto |
| 6,481,934 | B1 | 11/2002 | Alexiew |
| 6,503,853 | B1 | 1/2003 | Kassner et al. |
| 6,706,376 | B1 | 3/2004 | von Fransecky |
| 6,805,936 | B2 | 10/2004 | Seaton |
| 6,877,932 | B2 | 4/2005 | Prevost |
| 7,195,814 | B2 | 3/2007 | Ista et al. |
| 7,279,436 | B2 | 10/2007 | Pintz |
| 7,470,094 | B2 | 12/2008 | Heathcott et al. |
| 7,699,949 | B2 | 4/2010 | Newton et al. |
| 7,786,026 | B2 | 8/2010 | Newton et al. |
| 7,820,560 | B2 | 10/2010 | Weiser et al. |
| 8,043,689 | B2 | 10/2011 | Weiser |
| 8,333,220 | B2 | 12/2012 | King |
| 8,342,213 | B2 | 1/2013 | Sutton et al. |
| 8,486,847 | B2 | 7/2013 | Fan et al. |
| 8,598,054 | B2 | 12/2013 | King et al. |
| 8,691,906 | B2 | 4/2014 | Volkel et al. |
| 8,752,592 | B2 | 6/2014 | Sutton et al. |
| 9,243,356 | B2 | 1/2016 | Sutton et al. |
| 2004/0224591 | A1 | 11/2004 | Thai et al. |
| 2005/0287343 | A1 | 12/2005 | Weiser |
| 2009/0004430 | A1* | 1/2009 | Cummins ..... E04H 9/10 428/113 |
| 2009/0176422 | A1* | 7/2009 | Patrick ..... D04H 1/407 442/1 |
| 2014/0010601 | A1* | 1/2014 | Bradley, Sr. ..... E02B 3/06 405/302.7 |
| 2014/0302735 | A1* | 10/2014 | Donovan ..... E02D 19/00 442/242 |

* cited by examiner

WATER-PERMEABLE WOVEN GEOTEXTILE

CROSS-REFERENCE TO RELATED APPLICATION

This application claims the benefit of U.S. Provisional Patent Application Ser. No. 62/169,043 filed Jun. 1, 2015, the entirety of which is hereby incorporated herein by reference for all purposes.

TECHNICAL FIELD

The present invention relates generally to the field of woven geotextiles, and more particularly to water-permeable ground-covering geotextile fabrics used as underlayments for roadways.

BACKGROUND

Geotextile fabrics are commonly installed over the ground, to provide soil reinforcement and/or stabilization so less gravel is needed for this, before laying down covering layers. Such geotextile fabrics are used for example in road construction as underlayments over which are laid down roadway surfaces such as asphalt, concrete, gravel, dirt, or aggregate. Conventional geotextile roadway underlayment fabrics generally include a flat warp fiber across the entire width of the fabric in conjunction with a fibrillated weft fiber. While such existing geotextile underlayments provide some benefits in soil reinforcement and/or stabilization, and generally provide the coverage necessary for filtration (to keep sediment from passing through), there remain areas for improvements.

For example, conventional geotextile underlayments limit the amount of water that can pass through them, which tends to cause rainwater to sheet off to the roadway edges and cause erosion issues, or to simply pool on the roadway surface. And in applications in which the roadway is temporary, such as for roads on farmland temporarily used in the extraction of oil and gas, it can be difficult to locate the geotextile underlayments so they can be removed, and sometimes they are missed and left behind intact where they can cause damage during subsequent use of the land, such as damage to farm equipment when the land is next farmed.

Accordingly, it can be seen that needs exist for improvements in geotextile underlayments to provide for increased water pass-through drainage and increased ease of locating them for removal. It is to the provision of solutions meeting these and/or other needs that the present invention is primarily directed.

SUMMARY

Generally speaking, the present invention relates to a water-permeable ground-covering woven geotextile fabric for providing soil reinforcement and/or stabilization, for example as an underlayment in road construction, that utilizes a series of round warp fibers, in combination with a series of flat warp fibers, across the width of the fabric to increase water flow while still providing desired filtration. In particular, the round warp fibers form angles that allow greater amounts of water to pass through the fabric. In addition, using both round and flat warp fibers results in increased roughness of the fabric surface, which makes the fabric more resistant to being pulled out of the soil. Furthermore, one or more of the round and/or flat warp fibers can include a color selected for high visibility to the human eye in daylight conditions.

These and other aspects, features, and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the example embodiments are explanatory of representative and example embodiments of the invention, and are not restrictive of the invention, as claimed.

DETAILED DESCRIPTION OF EXAMPLE EMBODIMENTS

Figure 1:
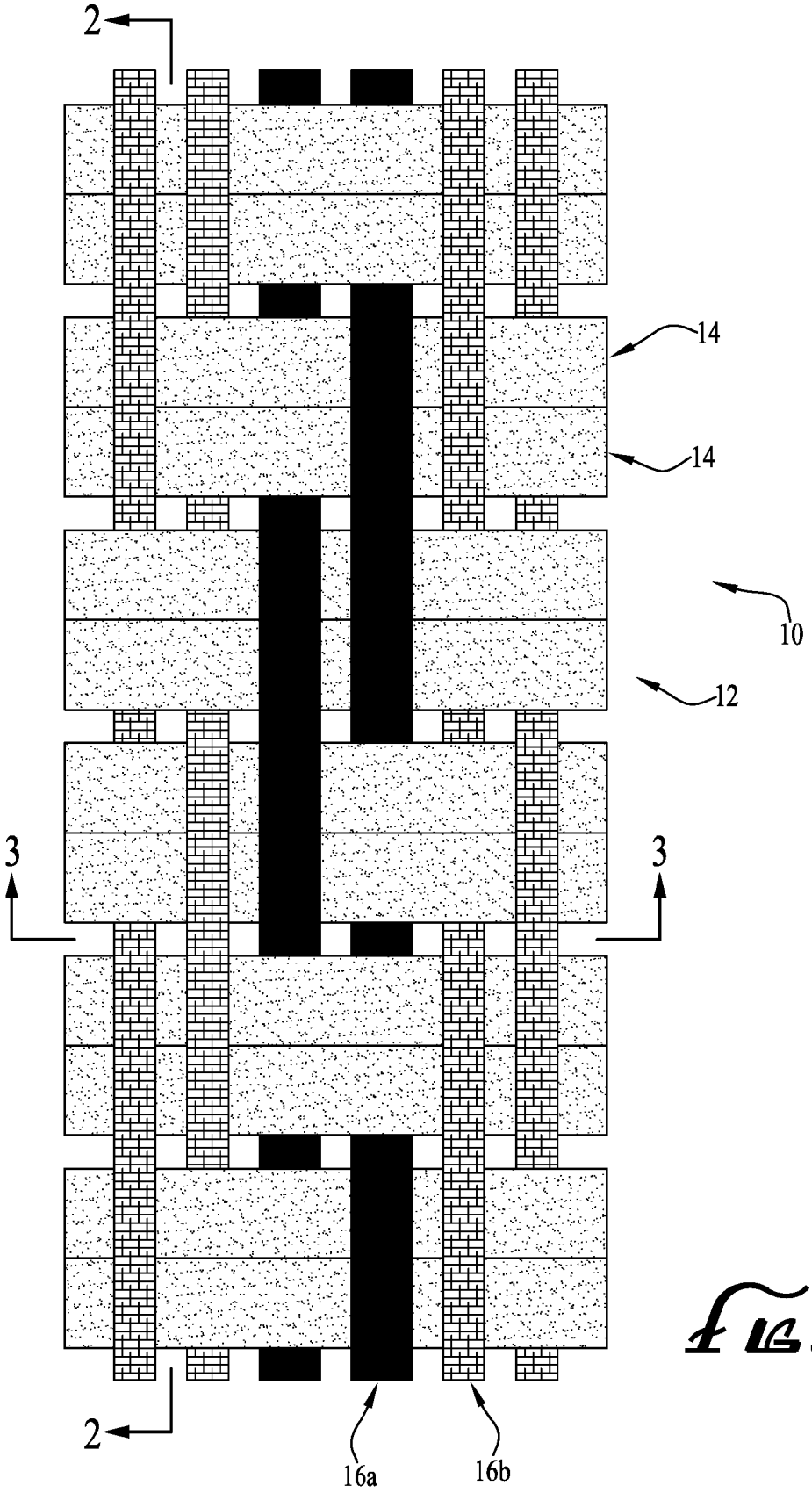
FIG. 1 is a plan view a woven geotextile fabric according to an example embodiment of the present invention.
Figure 2:
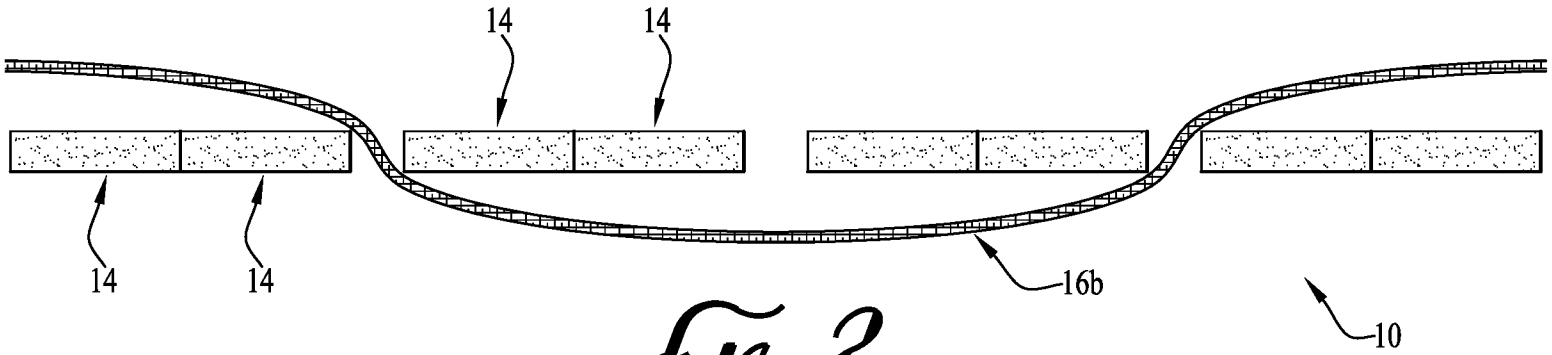
FIG. 2 is a cross-sectional view of the woven geotextile fabric taken at line 2-2 of FIG. 1, a weft/cross-machine cross-section viewed in the warp/machine direction, showing one of the warp fibers woven through the weft fibers, with the warp and weft fibers not shown to scale.

The present invention may be understood more readily by reference to the following detailed description of example embodiments taken in connection with the accompanying drawing figures, which form a part of this disclosure. It is to be understood that this invention is not limited to the specific devices, methods, conditions, or parameters described and/or shown herein, and that the terminology used herein is for the purpose of describing particular embodiments by way of example only and is not intended to be unnecessarily limiting of the invention as claimed. Any and all patents and other publications identified in this specification are incorporated by reference as though fully set forth herein.

Also, as used in the specification and the appended claims, the singular forms "a," "an," and "the" include the plural, and reference to a particular numerical value includes at least that particular value, unless the context clearly dictates otherwise. Ranges may be expressed herein as from "about" one particular value and/or to "about" another particular value. When such a range is expressed, another embodiment includes from the one particular value and/or to the other particular value. Similarly, when values are expressed as approximations, by use of the antecedent "about," it will be understood that the particular value forms another embodiment.

With reference now to the drawing figures, wherein like reference numbers represent corresponding parts throughout the several views, FIGS. 1-12 show a woven geotextile fabric 10 according to an example embodiment of the present invention. The geotextile fabric 10 can be used as an underlayment in road construction by being laid down covering the ground (e.g., directly over soil/earth, or with a gravel or other sub-layer therebetween) for soil reinforcement and/or stabilization, then having laid down over it a roadway surface (e.g., gravel, asphalt, concrete, dirt, aggregate, a combination thereof, or another roadway surface material). As used herein, the terms "road construction" and "roadway" are intended to have a broad meaning that includes not just travel pathways for vehicular traffic but also travel pathways for other types of transit such as airstrips, railroads, canals, bike paths, and walking trails. And in other applications, the geotextile fabric 10 is used (as shown and described, or with modifications that would be obvious to persons of ordinary skill in the art) as a ground cover without being covered by a roadway or other travel surface, or even a general-purpose water-permeable filtration sheet. As such, the geotextile fabric 10 of the invention as broadly defined is for wide-ranging applications and as specifically defined can be for roadway underlayment applications.

The geotextile fabric 10 is made or formed (e.g., cut) into sheets 12 that can be sized for a given use or application. For example, for typical applications the geotextile fabric 10 is provided in sheets 12 that are about 12 feet to about 18 feet wide, about 150 feet to about 900 feet long, rolled around a tube for compact storage until ready for use, and unrolled and cut to size for use.

The geotextile fabric 10 is woven from weft fibers 14 (arranged generally parallel in a weft direction) and transverse warp fibers 16*a* and 16*b* (collectively, the warp fibers 16) (arranged generally parallel in a warp direction), for example using conventional weaving techniques and equipment, and as such suitable weaving techniques and equipment are not detailed herein for brevity. The fibers 14 and 16 used to make the geotextile fabric 10 can be made of a conventional material known in the art, for example polypropylene monofilaments with UV stabilization, and as such suitable fiber materials are not detailed herein for brevity. The term "fibers" is intended to be broadly construed to include threads, yarns, tapes, and the like.

The weft fibers (aka the filling fibers) 14 can be of a conventional shape, size, and spacing. For example, the weft fibers 14 are typically flat (i.e., rectangular cross-sectionally and lying flat in the plane of the geotextile fabric sheet 12, see FIGS. 1-2), about 2000 to about 6000 denier, and arranged in pairs positioned together immediately adjacent (abutting or with only a negligible space therebetween such that the fibers disclosed herein could not pass through), with about 12 weft fibers per inch to about 40 weft fibers per inch, with the warp fibers 16 woven through selected spaces between adjacent weft fiber pairs, and with each weft fiber pair spaced apart from the adjacent weft fiber pair by at least the thickness of the warp fiber woven between them (somewhat less than that for spaces between weft fiber pairs through which a warp fiber is not woven). In a typical commercial embodiment, for example, the weft fibers 14 are flat (e.g., tape) and fibrillated, about 4600 denier, arranged in pairs positioned together, with about 16 weft fibers per inch, and with the warp fibers 16 woven through every other one of the spaces between adjacent weft fiber pairs. In these respects, the weft fibers 14 are sufficiently conventional that their construction, arrangement, and interrelationship are not further detailed herein for brevity.

At least some of the warp fibers 16 can be of a conventional shape, size, and spacing. For example, first warp fibers 16*a* are typically flat (i.e., rectangular cross-sectionally and lying flat in the plane of the geotextile fabric sheet 12, see FIGS. 1 and 3), about 6 mils to about 10 mils thick by about 20 mils to about 40 mils wide, and about 1000 to about 1800 denier, with each warp fiber spaced apart from the adjacent warp fiber by at least the thickness of the weft fiber woven between them (somewhat less than that for spaces between warp fibers through which a weft fiber is not woven). In a typical commercial embodiment, for example, the warp fibers 16*a* are flat, about 0.008-inch thick by about 0.033 inch wide, and about 1350 denier, with 34 warp fibers per inch in a slightly overlapping arrangement (e.g., see FIGS. 6-7). In these respects, the flat warp fibers 16*a* are sufficiently conventional that their construction, arrangement, and interrelationship are not further detailed herein for brevity.

A conventional geotextile product including such flat weft and flat warp fibers is commercially available under the designation G4x6 from Lumite, Inc. (Alto, Ga.). As such, further specifics of these elements will not be detailed herein for brevity.

In the present invention, however, not all of the warp fibers 16 are flat. Instead, the first warp fibers 16*a* are flat and conventional, and second warp fibers 16*b* are round. As used herein, the term "round" does not necessarily mean strictly circular in cross-section (i.e. cylindrical), but also includes elliptical or oval (or in some embodiments even extruded polygonal with at least five sides) in cross-section (and thus more accurately means "generally rounded").

The round warp fibers 16*b* can be of a conventional shape, size, and spacing. For example, the warp fibers 16*b* are typically round (e.g., elliptical and lying generally flat with their major axis in the plane of the geotextile fabric sheet 12, see FIGS. 1 and 3), about 20 mils to about 25 mils wide along their major axis by about 15 mils to about 20 mils thick along their minor axis, about 1500 to about 2000 denier, and spaced apart about 0.015 inch to about 0.045 inch from each other (in the plane of the geotextile fabric sheet 12). In a typical commercial embodiment, for example, the round warp fibers 16*a* are elliptical, about 0.024 inch wide by about 0.017 inch thick, about 1775 denier, and spaced apart about 0.027 inch wide.

Typically, the geotextile fabric 10 is formed with the sizes and spacings of the weft and warp fibers 14 and 16 selected for providing a sufficiently loose weave pattern to provide for sufficient flexibility of the fabric in the uses contemplated herein. This enables the use of more material in the cross-machine (weft) direction, which in turn results in the geotextile fabric 10 having a high strength such that it can resist the loads from heavy construction equipment in roadway applications.

Figure 3:
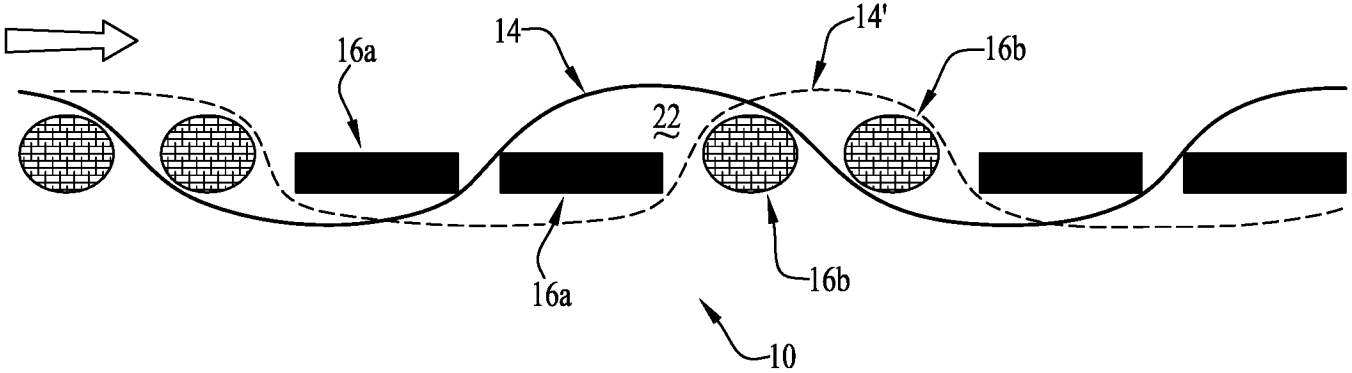
FIG. 3 is a cross-sectional view of the woven geotextile fabric taken at line 3-3 of FIG. 1, a warp/machine cross-section viewed in the weft/cross-machine direction, showing one of the weft fibers about which a series of warp fibers have been woven, with the warp and weft fibers not shown to scale, with the weft fibers deflecting around the warp fibers instead of the warp fibers doing most of the deflecting, and with the background weft fibers not shown for clarity of illustration.

In the depicted embodiment, the geotextile fabric 10 is formed by a generally planar serial arrangement of two flat warp fibers 16*a*, then two round warp fibers 16*b*, then two flat warp fibers 16*a*, then two round warp fibers 16*b*, and so on in a repeating fashion, as shown in FIG. 3. In this way, every flat warp fiber 16*a* is adjacent at least one round warp fiber 16*b*, and every round warp fiber 16*b* is adjacent at least one flat warp fiber 16*a* (this means, of course, except for end fibers, as they have only one adjacent fiber).

Figure 4:
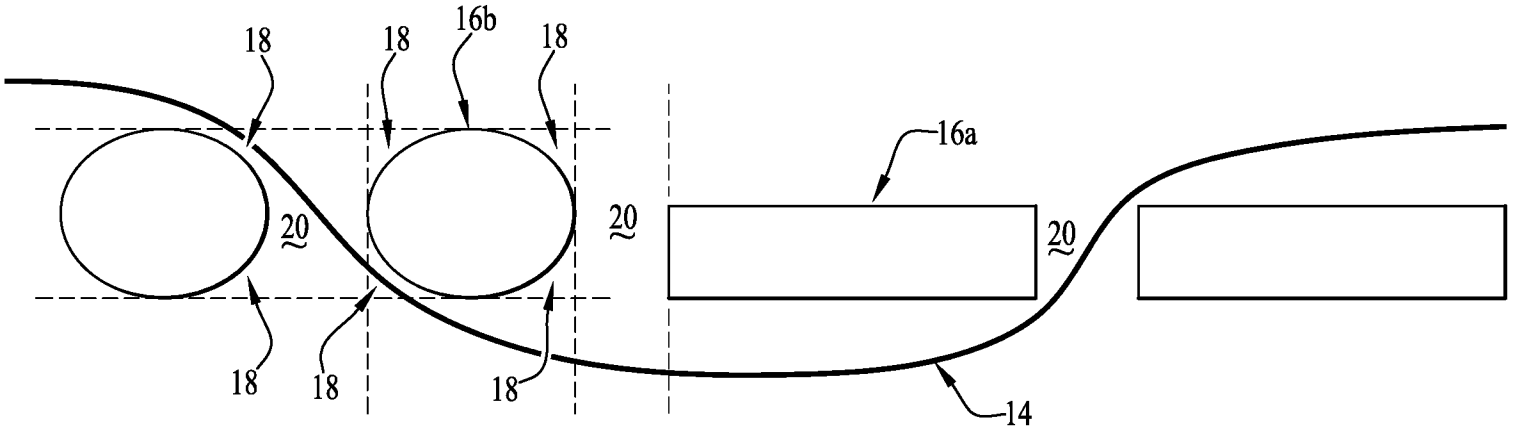
FIG. 4 shows a detail of the woven geotextile fabric of FIG. 3.

As shown in FIGS. 3-4, one of the weft fibers 14 is woven over the first of two adjacent round warp fibers 16*b*, then down through the matched/symmetrical warp-fiber space 20 between the two adjacent round warp fibers 16*b*, then under the second of the two adjacent round warp fibers 16*b*, then under the first of two adjacent flat warp fibers 16*a* after passing the non-matched/non-symmetrical warp-fiber space 20 between the second round warp fiber 16*b* and the first flat warp fiber 16*a*, then up through the matched/symmetrical warp-fiber space 20 between the two adjacent flat warp fibers 16*a*, then over the second of the two adjacent flat warp fibers 16*a*, then over a next first of two adjacent round warp fibers 16*b*, and so on in a repeating fashion. In this way, the weft fibers 14 are routed past one flat warp fiber 16*a*, past one non-matched/non-symmetrical warp-fiber space 20, and past one round warp fiber 16*b*, before being routed through a matched/symmetrical warp-fiber space 20, with this pattern repeating. As used herein, a non-matched or non-symmetrical warp-fiber space 20 is a space between a flat warp fiber 16*a* and a round warp fiber 16*b* (i.e., a round-flat fiber space), while a matched/symmetrical warp-fiber space 20 is a space between two flat warp fibers 16*a* or between two round warp fibers 16*b* (i.e., a round-round fiber space or a flat-flat fiber space).

Each weft fiber 14 is woven in an offset manner (offset by one warp-fiber space 20) relative to each adjacent parallel weft fiber. So going further with the specific example described in the preceding paragraph and as shown in FIG. 3, each of the adjacent parallel weft fibers 14' is woven over the first of two adjacent round warp fibers 16*b*, over the second of the two adjacent round warp fibers 16*b* after passing over the matched/symmetrical warp-fiber space 20 between the two adjacent round warp fibers 16*b*, then down through the non-matched/non-symmetrical warp-fiber space 20 between the second round warp fiber 16*b* and the first of two adjacent flat warp fibers 16*a* then under the second of the two adjacent flat warp fibers 16*a* after passing the matched/symmetrical warp-fiber space 20 between the two adjacent flat warp fibers 16*a*, then up through the non-matched/non-symmetrical warp-fiber space 20 between the second flat warp fiber 16*a* and a next first round warp fiber 16*b*, then over the next first round warp fiber 16*b*, and so on in a repeating fashion.

Accordingly, typically half of the warp fibers 16 are flat and the other half are round in a pattern that is nicely balanced. This tends to make it easier to get the fiber tensions correct and thus makes it easier to manufacture the geotextile fabric 10. This also tends to facilitate advantageous water-drainage features, as described in detail below. In alternative embodiments, the geotextile fabric is formed by an arrangement of alternating flat and round warp fibers (one of each in an alternating pattern, instead of two of each in an alternating pattern), of more than two flat warp fibers adjacent each other, and/or of more than two round warp fibers adjacent each other, while still in a balanced pattern.

In any event, the geotextile fabric 10 includes at least some round warp fibers 16*a* intermixed (preferably in a regular repeating manner) with the flat warp fibers 16*a* and extending across the width of the fabric so that there are adjacent round and flat warp fibers. Referring particularly to FIG. 4, the round warp fibers 16*a* define curved-wedge elongated drain openings 18, with each drain opening in communication with the two opposing spaces 20 between the two adjacent parallel warp fibers. The elongation of the drain openings 20 is along the length of the round warp fibers, and the curved-wedge cross-sectional shape results from the four rounded-off corners (relative to a flat fiber). As such, each round warp fiber 16*a* defines four drain openings, with one at each of the four rounded-off corners. These angled drain openings 18 promote greater amounts of water passing through the warp-fiber spaces 20 for increased water-flow rates through the geotextile fabric 10. That is, compared to a geotextile fabric with only flat warp fibers and with the same spacing between the warp fibers, the angled drain openings 18 of the depicted geotextile fabric 10 function as ramps that induce more water to drain into the spaces 20 between the warp fibers so it can then pass through the fabric (as can be seen with reference to the horizontal and vertical planes in hashed lines). So more water is funneled to the warp-fiber spaces and thereby drained through the geotextile fabric 10 into the soil under it, instead of just sheeting across and off of its outer edges.

In addition, including the round warps fibers 16*b* increases the edge-to-edge drain space 20 between the warp fibers while using the same number and center-to-center spacing of warp fibers. The strength of the fabric 10 can be maintained by using round warp fibers 16*b* having substantially the same mass and strength as the flat warp fiber 16*a*. But the round warp fibers 16*b* have a narrower cross-sectional width relative to the flat warp fibers 16*a* of the same mass and strength. Because the round warp fibers 16*b* have a smaller width (in the horizontal plane of the fabric sheet 12), when they are arranged with the same center-to-center spacing as the flat warp fibers 16*a*, the resulting non-matched/non-symmetrical warp-fiber spacings 20 as well as the resulting matched/symmetrical round-round warp-fiber spacings 20 are increased (relative to the matched/symmetrical flat-flat warp-fiber spacings 20. These increased warp-fiber spacings 20 provide for even greater water drainage through the geotextile fabric 10.

In the depicted embodiment, the flat warp fibers 16*a* have a larger width than the round warp fibers 16*b*, but the flat warp fibers have a smaller thickness (height) than the round warp fibers. So where the weft fibers 14 traverse between adjacent shorter/flat and taller/round warp fibers 16*a* and 16*b*, they are angled up or down and thus spaced above or below the top or bottom surface of the flat warp fiber 16*a*. This results in a weft clearance space 22 (above or below the top or bottom surface of the flat warp fiber 16*a*) at locations where the weft fibers 14 cross adjacent flat and round warp fibers 16*a* and 16*b* (see FIGS. 3 and 10). These clearance spaces 22 allow water to flow longitudinally (i.e., along a flat warp fiber 16*a*, between the flat warp fiber and the transverse flat weft fibers 14) over the geotextile fabric 10 and then drain into the warp-fiber openings 20 so that more water is passed through the fabric. In alternative embodiments, the flat warp fibers have a larger thickness (height) than the round warp fibers, to produce a similar effect.

It should be noted that in FIGS. 3-4, the bottoms of the flat and round warp fibers 16*a* and 16*b* are aligned, with the tops of the round warp fibers positioned above the tops of the flat warp fibers. But typically a sinusoidal S-curve is created by the crimping effect of the warp ends in the woven fabric 10, this is not readily illustrated, and these figures are not to scale, so these figures are not true representations of the actual configuration of and interrelationship between the fibers (position, proportion, curvature, spacing, etc.). FIGS. 6-12 provide truer (to scale, or at least much closer to scale) representations of the positions, proportions, and S-curve of the fibers 14 and 16 of the woven geotextile fabric 10 (note in particular FIGS. 7, 10, and 12). In typical commercial embodiments, the averaged centerlines of the sinusoidal-curved flat and round warp fibers 16*a* and 16*b* generally align in the plane of the fabric sheet 12 (with each individual fiber slightly offset from one or both adjacent fibers, see FIGS. 10-11), with the tops of the round warp fibers positioned above the tops of the flat warp fibers, and with the bottoms of the round warp fibers positioned below the bottoms of the flat warp fibers, thereby producing an unevenness of the top and bottom surfaces of the fabric 10 to help water drain into the angled drain openings 18 and through the fabric 10.

In addition, because the inclusion of the round warp fibers 16*b* mixed in with the flat warp fibers 16*a* produces the unevenness of the top and bottom surfaces of the fabric 10, the angled drain openings 18 tend to trap soil in them. This results in a roughness of the fabric top and bottom surfaces such that the fabric is more resistant to being pulled out of the soil (especially when pulled generally parallel to the soil for example when accidentally caught or snapped by equipment). This retention feature helps keep the geotextile fabric 10 in place during use.

Furthermore, in the depicted embodiment, some of the fibers 14 and 16 have a color selected for high visibility to the naked human eye in daylight and lowlight conditions. For example, the round warp fibers 16*b* can be a bright yellow (e.g., using a conventional method of blending color/dye into fiber during fiber extrusion), or another color for high visibility and/or sharp contrast with the flat warp fibers 16*a* and/or with the weft fibers 14 (e.g., which can be provided for example in a black or other contrasting color). In the depicted embodiment, the high-visibility round warp fibers 16*b* are indicated by hatching in FIGS. 1-3 and 5. The remaining fibers not colored for high visibility can be different colors (as depicted) or the same color, with typically at least one type of the remaining fibers having a contrasting color. The colors/dyes can be concentrates mixed into the plastic material before forming into fibers, they can be sprayed or otherwise applied onto the fibers (e.g., by dipping) after they are formed, etc. This enables the geotextile fabric 10 to be more easily seen so it can be removed after temporary roadways are returned to other uses such as farming. In alternative embodiments, the high-visibility color is included in the flat warp fibers 16*a*, the weft fibers 14, or a combination thereof.

The typical commercial embodiment of the geotextile fabric 10 as depicted and described herein has been tested and proven to provide strength and water-flow benefits. Ranges of this typical fabric 10 are listed below in Table 1.

TABLE 1

| | | |
|---|---|---|
| Wide width tensile strength - ultimate (MD × CD) | ASTM D4595 | 4800-6000 × 6000-8400 lbs/ft |
| Apparent opening size (AOS) | ASTM D4751 | 30-40 US Std. Sieve |
| Water flow rate | ASTM D4491 | 40-75 gal/min/ft$^2$ |

Additional details of the manufacture of example embodiments of the geotextile fabric 10 include the weave pattern and the harness draw, showing how the harnesses work to weave in the pattern. Details of a sample weave pattern are provided in Table 2.

TABLE 2

| Harness Weave Pattern | |
|---|---|
| 1. | 5, 6, 9, 10 up |
| 2. | 5, 6, 9, 10 up |
| 3. | 3, 6, 7, 10 up |
| 4. | 3, 6, 7, 10 up |
| 5. | 3, 4, 7, 8 up |
| 6. | 3, 4, 7, 8 up |
| 7. | 4, 5, 8, 9 up |
| 8. | 4, 5, 8, 9 up |

Figure 5:
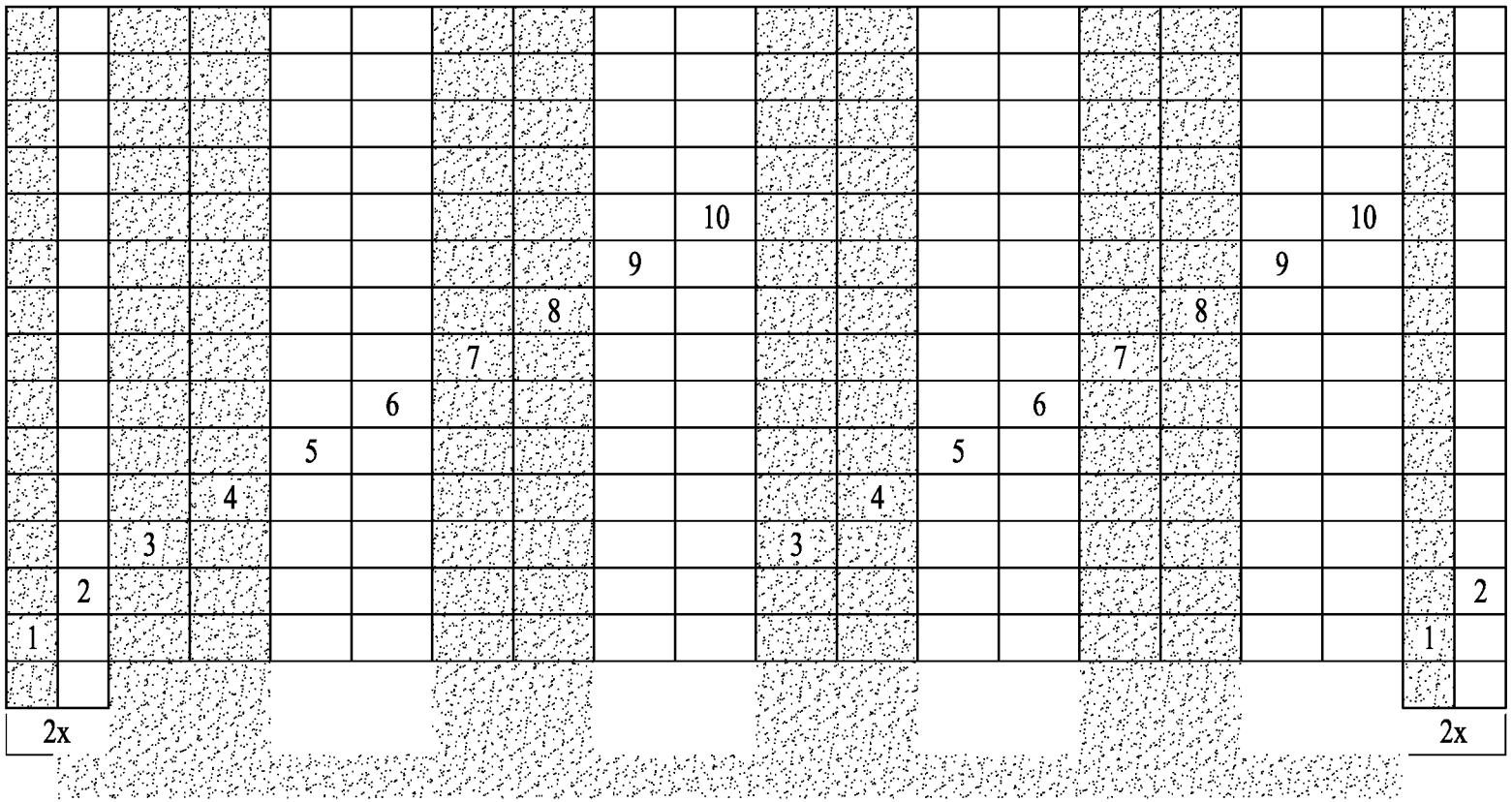
FIG. 5 is a sample harness draw graph of the woven geotextile fabric of FIG. 1.
Figure 6:
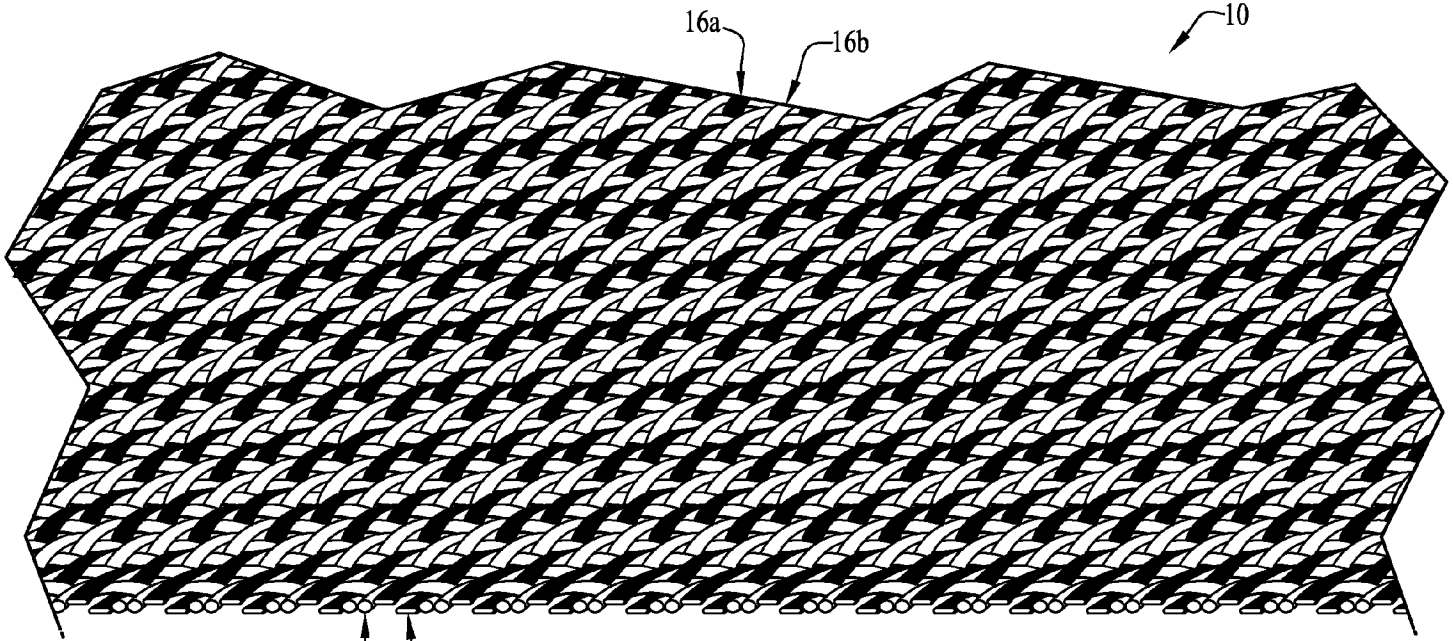
FIG. 6 is a perspective view from a warp/machine end of a portion of the woven geotextile fabric of FIG. 1.

And details of a sample harness draw graph are provided in FIG. 5. The depicted harness draw graph section repeats itself for example 390 times between selvages, and harnesses 3, 4, 7, and 8 can be the high-visibility colored fiber harneses. As such, an aspect of the invention includes methods of manufacturing the geotextile fabric 10 as described herein.

In other embodiments, the geotextile fabric includes some round weft fibers mixed in with some flat weft fibers and extending along the length of the fabric sheet. And in still other embodiments, the geotextile fabric includes some round weft fibers mixed in with some flat weft fibers and extending along the length of the fabric sheet and also some round warp fibers mixed in with some flat warp fibers and extending across the width of the fabric sheet.

In the depicted embodiment, the warp fibers 16 are provided in spaced pairs of like type (i.e., a flat pair or a round pair), with a flat warp fiber 16*a* pair, then a round warp fiber 16*b* pair, then a next flat warp fiber 16*a* pair, then a next round warp fiber 16*b* pair, and so on, with a warp-fiber space 20 between each warp fiber. In other embodiments, the warp fibers are provided in rows of three or more spaced fibers of like type, or arranged with individual alternating flat and round fibers, with a flat warp fiber row, then a round warp fiber row, then another flat warp fiber row, then another round warp fiber row, and so on, with a warp-fiber space between each warp fiber. As such, as used herein reference to a "fiber row" includes a pair of parallel adjacent spaced fibers, more than two such spaced fibers, or a single fiber.

In the depicted embodiment, the warp fibers 16 are woven through every other one of the spaces between adjacent weft fiber 14 pairs. In other embodiments, the warp fibers are woven through each/every one of the spaces between adjacent weft fiber pairs, through every third or more of the spaces, or through similarly selected spaces between individual weft fibers (not paired). For example, in an embodiment in which each warp fiber set includes three warp fibers of like type, the weft fibers can be woven through every warp-fiber space, through every other warp-fiber space, through every third warp-fiber space, etc. Similarly, in an embodiment in which each warp fiber set includes a single warp fiber (flat or round), the weft fibers can be woven through every warp-fiber space, through every other warp-fiber space, through every third warp-fiber space, etc.

Figure 7:
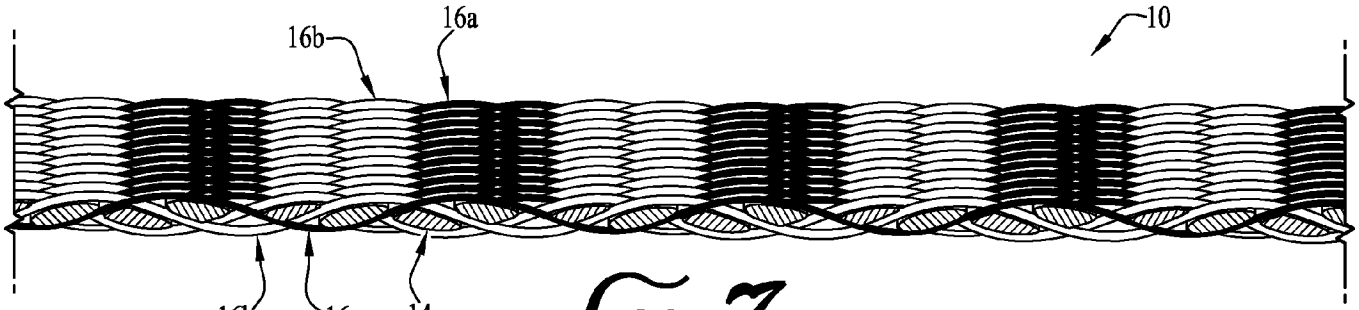
FIG. 7 is a weft/cross-machine end view of a portion of the woven geotextile fabric of FIG. 1.
Figure 8:
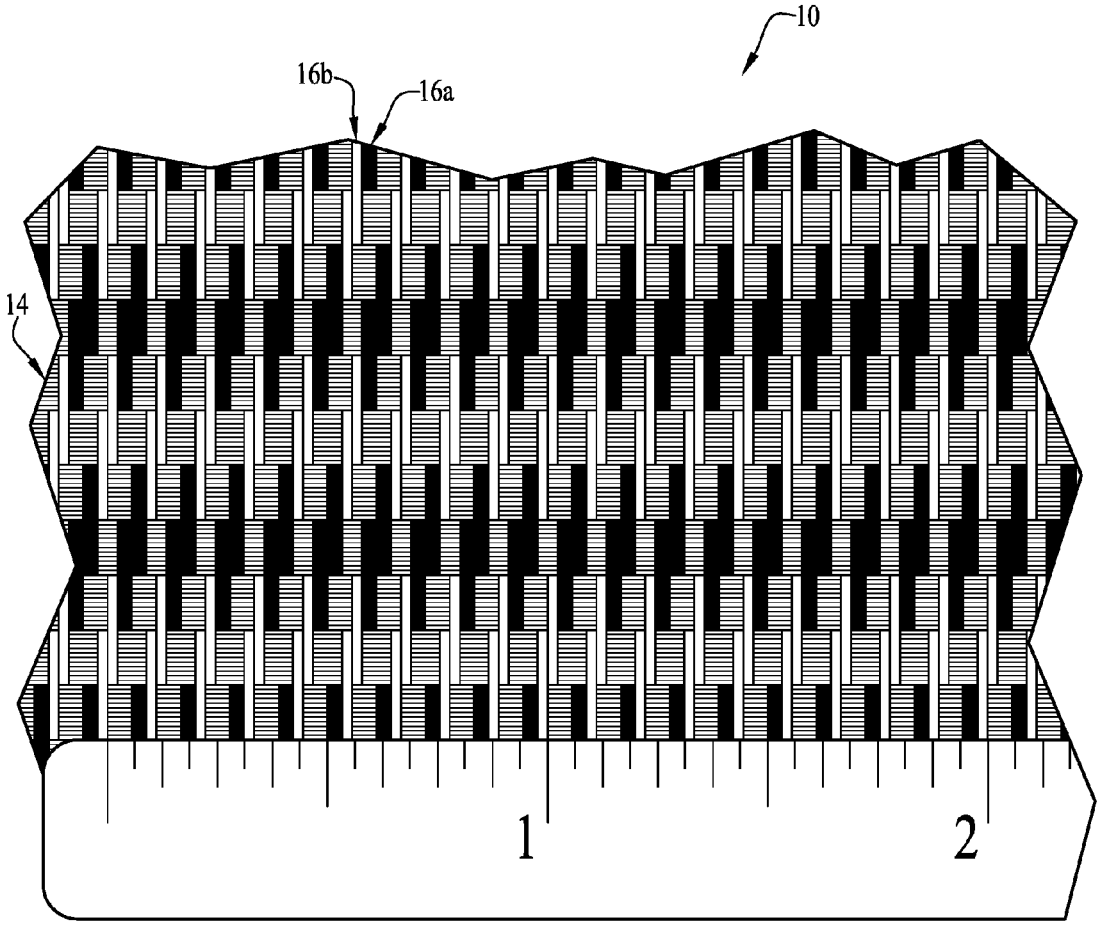
FIG. 8 is a top view of a portion of the woven geotextile fabric of FIG. 1, showing typical representative dimensions.
Figure 9:
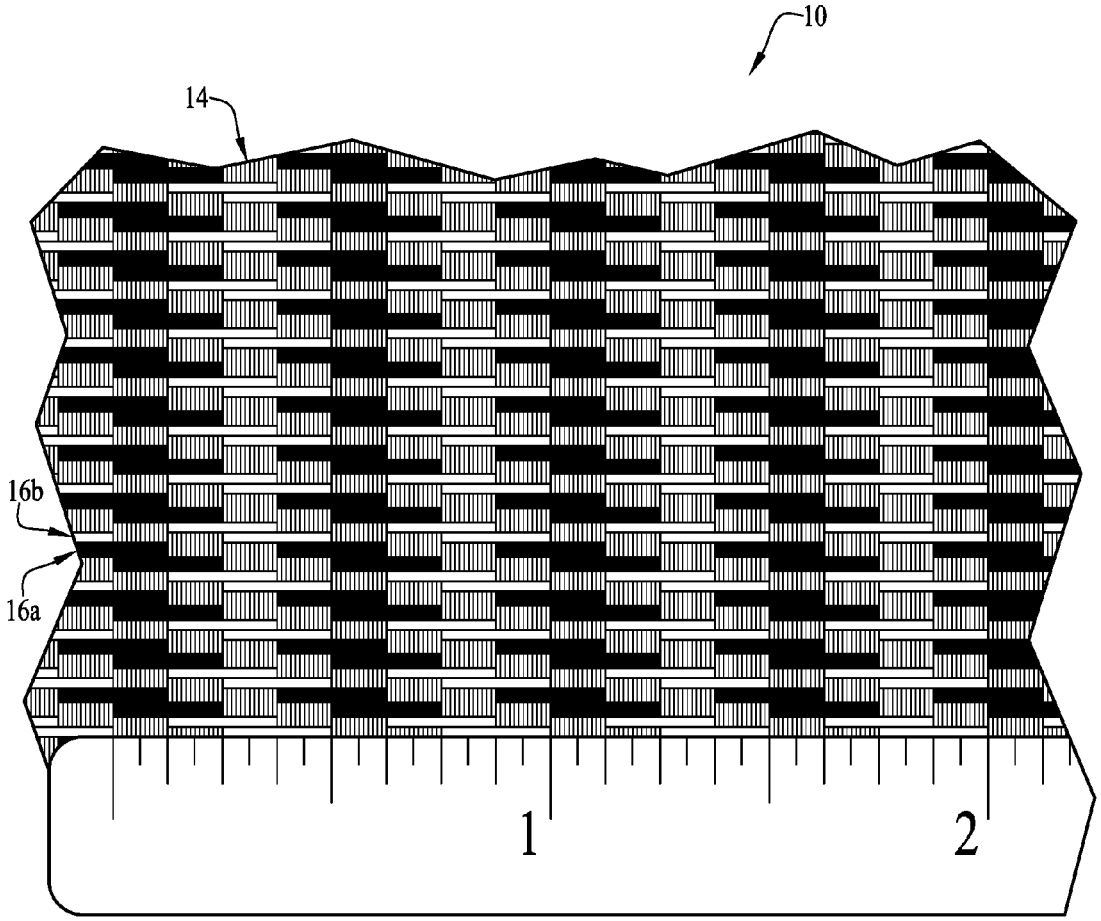
FIG. 9 is a transverse top view of the portion of the woven geotextile fabric of FIG. 8, showing typical representative dimensions.
Figure 10:
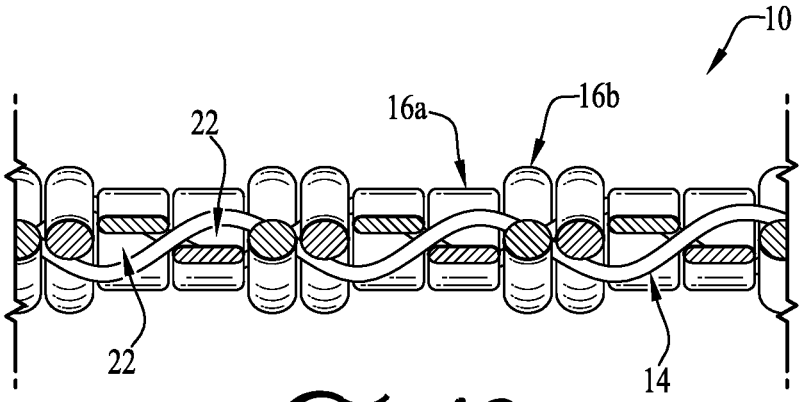
FIG. 10 is a detail end view of the woven geotextile fabric of FIG. 6, generally showing the cross-sectional of FIG. 3 to a representative scale.
Figure 11:
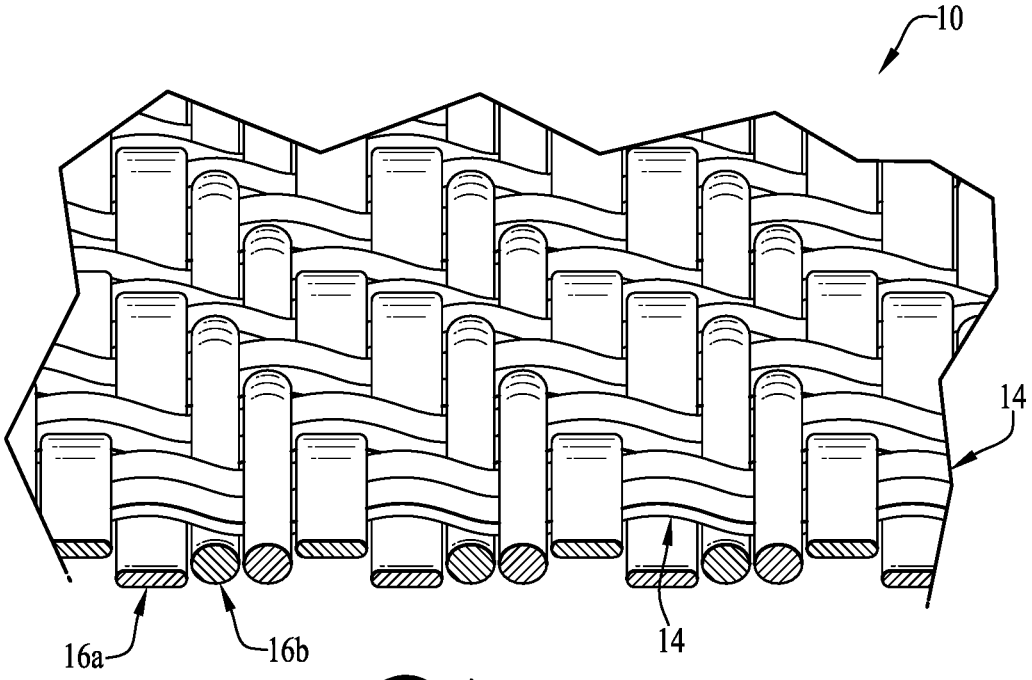
FIG. 11 is a perspective view of the woven geotextile fabric detail of FIG. 10.
Figure 12:
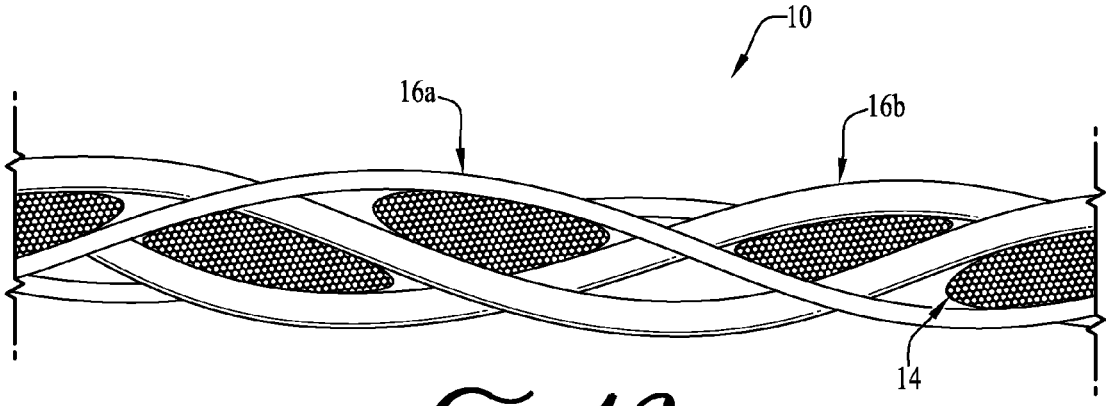
FIG. 12 is a detail end view of the woven geotextile fabric of FIG. 7, generally showing the cross-sectional of FIG. 2 to a representative scale

In the depicted embodiment, the weft fibers 14 are arranged in pairs immediately adjacent to each other (see FIGS. 1-2 and 11) or arranged individually (with a space on each side; not in pairs) (see FIGS. 7 and 12). In other embodiments, the weft fibers are arranged in sets of three or more fibers. Multiple weft fibers (or multiple warp fibers) arranged immediately adjacent each other (abutting or with only a negligible space therebetween such that the fibers disclosed herein could not pass through) can be considered to be a single weft fiber (or a single warp fiber, respectively). As such, as used herein reference to a "fiber set" includes a pair of fibers immediately adjacent to each other, more than two fibers so arranged, or a single fiber.

In another aspect, the invention relates to a roadway including the geotextile fabric 10 positioned over soil and a roadway surface (e.g., gravel, asphalt, concrete, and/or dirt) positioned over the fabric. And in another aspect, the invention relates to a method of installing a roadway, including installing the geotextile fabric over soil and then installing a roadway surface over the fabric.

While the invention has been described with reference to preferred and example embodiments, it will be understood by those skilled in the art that a variety of modifications, additions and deletions are within the scope of the invention, as defined by the following claims.

What is claimed is:

1. A water-permeable geotextile fabric for providing soil reinforcement and/or stabilization, comprising:

a series of first-direction fibers arranged generally parallel in a first direction; and a series of second-direction fibers arranged generally parallel in a second direction that is transverse to the first direction, wherein the first-direction fibers are woven through second-direction-fiber spaces between adjacent ones of the second-direction fibers, wherein the second-direction fibers include first-shape fibers and second-shape fibers that are differently shaped in cross-section from the first-shape fibers, wherein the first-shape second-direction fibers and the second-shape second-direction fibers are intermixed so that at least some of the first-shape second-direction fibers are adjacent to respective ones of the second-shape second-direction fibers, and wherein the second-shape second-direction fibers define ramped drain openings that communicate with and induce water to drain into the second-direction-fiber spaces for increased waterflow through the geotextile fabric.

2. The geotextile fabric of claim 1, wherein the first-direction fibers are weft fibers and the second-direction fibers are warp fibers.

3. The geotextile fabric of claim 1, wherein the first-shape second-direction fibers are flat fibers and the second-shape second-direction fibers are round fibers.

4. The geotextile fabric of claim 3, wherein the ramped drain openings have a curved-wedge shape defined in part by the round second-direction fibers.

5. The geotextile fabric of claim 1, wherein the second-shape second-direction fibers have a greater thickness/height than the first-shape second-direction fibers, wherein the first-direction fibers passing across adjacent ones of the second-shape second-direction fibers and the first-shape second-direction fibers are spaced above or below the passed-across first-shape second-direction fibers to define clearance spaces through which water can drain along the first-shape second-direction fibers.

6. The geotextile fabric of claim 5, wherein due to the clearance spaces between the first-direction fibers and the passed-across first-shape second-direction fibers, the second-shape second-direction fibers and the first-shape second-direction fibers define uneven top and bottom surfaces of the geotextile fabric that trap soil during use to help retain the geotextile fabric in place in use.

7. The geotextile fabric of claim 1, wherein at least some of the first-direction fibers, the second-direction fibers, or both, have a high-visibility color such that the geotextile fabric is more easily seen for removal in temporary installations.

8. The geotextile fabric of claim 1, wherein the first-shape second-direction fibers and the second-shape second-direction fibers are intermixed in a regular repeating manner.

9. The geotextile fabric of claim 8, wherein pairs of the first-shape second-direction fibers and pairs of the second-shape second-direction fibers are intermixed in an alternating manner.

10. The geotextile fabric of claim 1, wherein the first-direction fibers are woven through every other one or more of the second-direction-fiber spaces.

11. The geotextile fabric of claim 1, wherein the adjacent ones of the first-direction fibers are woven through the second-direction-fiber spaces in an offset manner offset by one of the second-direction-fiber spaces.

12. The geotextile fabric of claim 1, wherein the fabric is for use as an underlayment in a roadway.

13. A roadway including the geotextile fabric of claim 1 as an underlayment.

14. A method of making the geotextile fabric of claim 1, including the steps of weaving the first-direction fibers through the first-shape first-direction fibers and the second-shape first-direction fibers in a regular repeating manner to form the drain openings in communication with the second-direction-fiber openings.

15. A water-permeable geotextile fabric for providing soil reinforcement and/or stabilization, comprising:

a series of weft fibers arranged generally parallel in a first direction; and a series of warp fibers arranged generally parallel in a second direction that is transverse to the first direction, wherein the weft fibers are woven through warp-fiber spaces between adjacent ones of the warp fibers, wherein the warp fibers include flat warp fibers and round warp fibers, wherein the flat warp fibers and the round warp fibers are intermixed so that at least some of the flat warp fibers are adjacent to respective ones of the round warp fibers, wherein the round warp fibers define ramped drain openings that communicate with and induce water to drain into the warp-fiber spaces for increased waterflow through the geotextile fabric, wherein the ramped drain openings have a curved-wedge shape defined in part by the round warp fibers, and wherein the weft fibers are woven through every other one or more of the warp-fiber spaces.

16. The geotextile fabric of claim 15, wherein the round warp fibers have a greater thickness/height than the flat warp fibers, wherein the weft fibers passing across adjacent ones of the round warp fibers and the flat warp fibers are spaced above or below the passed-across flat warp fibers to define clearance spaces through which water can drain along the flat warp fibers, and wherein due to the clearance spaces between the weft fibers and the passed-across flat warp fibers, the round warp fibers and the flat warp fibers define uneven top and bottom surfaces of the geotextile fabric that trap soil during use to help retain the geotextile fabric in place in use.

17. The geotextile fabric of claim 15, wherein at least some of the weft fibers, the flat warp fibers, or both, have a high-visibility color such that the geotextile fabric is more easily seen for removal in temporary installations.

18. The geotextile fabric of claim 15, wherein the flat warp fibers and the round warp fibers are intermixed in a regular repeating manner.

19. The geotextile fabric of claim 15, wherein the adjacent ones of the weft fibers are woven through the warp-fiber spaces in an offset manner offset by one of the warp-fiber spaces.

20. The geotextile fabric of claim 15, wherein the fabric is for use as an underlayment in a roadway.

* * * * *